US007650674B2

(12) United States Patent
Miyazaki et al.

(10) Patent No.: US 7,650,674 B2
(45) Date of Patent: Jan. 26, 2010

(54) SLIDER FOR SLIDE FASTENER WITH AUTOMATIC STOPPER

(75) Inventors: Yohei Miyazaki, Toyama (JP); Keiichi Keyaki, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/249,296

(22) Filed: Oct. 10, 2008

(65) Prior Publication Data

US 2009/0094804 A1 Apr. 16, 2009

(30) Foreign Application Priority Data

Oct. 12, 2007 (JP) ..... P2007-266764

(51) Int. Cl.
*A44B 19/30* (2006.01)
*A44B 19/26* (2006.01)

(52) U.S. Cl. ..... 24/424; 24/429

(58) Field of Classification Search ..... 24/429–431, 24/421, 424
See application file for complete search history.

(56) References Cited

U.S. PATENT DOCUMENTS 4,667,376 A * 5/1987 Ishii et al. ..... 24/421
6,993,810 B2 * 2/2006 Hamada ..... 24/424
7,464,445 B1 * 12/2008 Lin ..... 24/415

FOREIGN PATENT DOCUMENTS

JP A-2004-147729 5/2004

* cited by examiner

*Primary Examiner*—James R Brittain
(74) *Attorney, Agent, or Firm*—Alston & Bird LLP

(57) ABSTRACT

A slider for a slide fastener with an automatic stopper, includes: a body; a pull; a pawl rod; a leaf spring; and a cover including front, back, side and upper walls. The side walls are provided at respective centers thereof with openings through which a pivotal shaft of the pull can be passed. A pair of mounting parts are provided in the front and in the back on an upper wing plate of the body. Holding mechanisms for holding the leaf spring are provided in the front and in the back on an inner face of the cover at respective positions inwardly separated from the front wall and the back wall. The leaf spring defines spaces between the holding mechanisms and the upper wall. The holding mechanisms hold the leaf spring at positions inwardly separated from opposite ends thereof. The cover is fixed to the front and back mounting parts.

8 Claims, 14 Drawing Sheets

SLIDER FOR SLIDE FASTENER WITH AUTOMATIC STOPPER

BACKGROUND OF THE INVENTION

The present invention relates to a slider for a slide fastener with an automatic stopper which includes five members, namely, a body, a pull, a pawl rod, a leaf spring and a cover, and more particularly to the slider for the slide fastener in which the leaf spring and the cover can be accurately mounted on the body of the slider in a stabilized state, and the leaf spring can be effectively and smoothly operated, in either case of automatically assembling or manually assembling the slider.

JP-A-2004-147729 ("the '229 application") discloses a slider with an automatic stopper that includes five members, namely, a body, a pull, a pawl rod, a leaf spring and a cover. For example, as shown in FIG. 12, the slider includes an automatic stopper which includes five members, namely, a body 101, a pull 102, a pawl rod 103, a leaf spring 104 and a cover 105. In this slider, mounting poles 108 are uprightly provided at an interval in the front and in the back of an upper wing plate 107 of the body 101. First holding parts 109 for holding the leaf spring 104 in a shape of a rectangular plate are provided on respective upper faces of the mounting poles 108, which are uprightly provided in the front and back, and second holding parts 110 for holding the leaf spring 104 are provided at a front and back ends of an inner face of the cover 105. The leaf spring 104 is loosely suspended between these holding parts 109, 110, and a pivotal shaft 124 of the pull 102 and the pawl rod 103 are interposed between the leaf spring 104 and the upper wing plate 107. The cover 105 is fixed from above to the mounting poles 108, which are uprightly provided on the upper face of the upper wing plate 107.

In order to effectively secure the leaf spring 104 and the cover 105 in the slider of this type by automatic assembling work or manual assembling work, in case of employing an automatic assembling device, the pivotal shaft 124 of the pull 102 is placed between slanted faces 111 that are provided on the upper face of the body 101, engaging projections 122 of the pawl rod 103 are inserted into a recessed part 114 from the above, a stop pawl 123 is inserted into a pawl hole 118, and the leaf spring 104 is suspended on the first holding parts 109 provided on the upper faces of the front and back mounting poles 108 that are uprightly provided on the upper wing plate 107 of the body 101, as shown in FIG. 13. In the state where the pivotal shaft 124 of the pull 102 is interposed between the leaf spring 104 and the slanted faces 111 and the pawl rod 103 is placed thereon, the cover 105 is put on from the above in a manner of covering the mounting poles 108, so that the first holding parts 109 are engaged with second receiving parts 116 and the second holding parts 110 are engaged with first receiving parts 115. Thereafter, the cover 105 is fixed by caulking to side faces of the mounting poles 108, whereby the slider with the automatic stopper can be assembled.

In case of assembling the slider by the manual assembling work, the pivotal shaft 124 of the pull 102 is placed between the slanted faces 111 that are provided on the upper face of the body 101, the engaging projections 122 of the pawl rod 103 are inserted into the recessed part 114 from the above, and the stop pawl 123 is inserted into the pawl hole 118, as shown in FIG. 14. At the same time, concave parts of the leaf spring 104 are engaged with the second holding parts 110 having projections 112 which are provided at a front end and a back end of an inner face of an upper wall 132 of the cover 105, and the projections 112 each having a V-shaped groove are folded to the right and left thereby to hold the leaf spring 104. The cover 105 in this state is put on the mounting poles 108 so that the first holding parts 109 are engaged with the second receiving parts 116 and the second holding parts 110 are engaged with the first receiving parts 115. Thereafter, the cover 105 is fixed to the side faces of the mounting poles 108 by caulking, whereby the slider with the automatic stopper can be assembled.

In the above described slider with the automatic stopper as shown in FIGS. 12, 13 and 14, the leaf spring 104 is suspended between the first holding parts 109 on the upper faces of the mounting poles 108, which are uprightly provided in the front and back of the body 101, and the cover 105 is put on from the above so as to cover the mounting poles 108 so that the first holding parts 109 are engaged with the second receiving parts 116 and the second holding parts 110 are engaged with the first receiving parts 115. Then, the cover 105 is fixed to the mounting poles 108 by caulking. On this occasion, in either case of automatic assembling and manual assembling, loose movement of the opposite ends of the leaf spring 104 is hindered and the movement is restricted because the opposite ends of the leaf spring 104 are clamped between the second holding parts 110 and the upper wall 132 of the cover 105. Therefore, high caulking accuracy for holding the opposite ends of the leaf spring 104 is required. In case where the accuracy is low, there is no room for the movement of the leaf spring 104, and an interference with the holding parts 110 may occur. As the results, there is such a problem that the leaf spring 104 cannot smoothly move, or the leaf spring 104 may be plastically deformed to lose elasticity.

BRIEF SUMMARY OF VARIOUS EMBODIMENTS OF THE INVENTION

It is therefore an object of various embodiments of the invention to provide a slider for a slide fastener with an automatic stopper which includes five members, namely, a body, a pull, a pawl rod, a leaf spring and a cover, and can be easily assembled either automatically or manually, wherein the leaf spring to be mounted is held in an extremely stabilized state, and opposite ends of the leaf spring can loosely move, and can smoothly swing in a vertical direction.

It is also an object of various embodiments of the invention to specify a shape of the leaf spring and a leaf spring holding mechanism of the cover, for example, to provide the slider for the slide fastener with the automatic stopper in which projections are provided at positions inwardly separated by a certain distance from a front wall and a back wall of the cover, that is, at the positions closer to a center of the body, to be engaged with cutouts in a concave shape formed in tip ends of the leaf spring, and supporting pieces are provided on side walls of the cover adjacent to the projections to loosely hold the leaf spring by folding tip ends of the supporting pieces, or projections whose heads can be spread toward the right and left side walls are provided at positions inwardly separated from opposite ends of the cover to be engaged with the cutouts in a concave shape formed in the tip ends of the leaf spring, and the heads of the projections are spread toward the right and left side walls to loosely secure the leaf spring, whereby the opposite ends of the leaf spring can be freely moved.

It is also an object of various embodiments of the invention to provide the slider for the slide fastener with the automatic stopper in which parts for mounting the cover which are provided in the front and back of the body of the slider are specified, and a manner of effectively receiving holding mechanisms which are provided in the front and back on an inner face of the cover is specified, whereby the cover can be accurately mounted on the body of the slider, and elasticity of the leaf spring can be efficiently exerted.

It is also an object of various embodiments of the invention to provide the slider for the slide fastener with the automatic stopper in which a shape of the body of the slider on which the leaf spring, the cover, the pull and the pawl rod are mounted is specified, whereby the respective members can smoothly work in cooperation with one another in an effective and stabilized state.

It is also an object of various embodiments of the invention to provide the slider for the slide fastener with the automatic stopper in which the shape of the cover, the shapes of the projections and supporting pieces provided on the inner face of the cover, or the shape of the projections which are provided on the inner face of the cover and can be spread are specified, whereby the elasticity of the leaf spring can be smoothly exerted, by effectively utilizing the grooves and spaces which are provided on the inner face of the cover.

It is also an object of various embodiments of the invention to provide the slider for the slide fastener with the automatic stopper in which a manner of effectively providing the spaces on the inner face of the cover is specified, whereby the movement of the leaf spring can be efficiently performed by effectively utilizing the spaces.

According to various embodiments of the invention, there is provided a slider for a slide fastener with an automatic stopper, comprising: a body; a pull; a pawl rod; a leaf spring; and a cover, wherein the cover includes a front wall, a back wall, side walls and an upper wall, the side walls are provided at respective centers thereof with openings through which a pivotal shaft of the pull can be passed, a pair of mounting parts are provided in the front and in the back on an upper wing plate of the body, holding mechanisms for holding the leaf spring are provided in the front and in the back on an inner face of the cover at respective positions inwardly separated from the front wall and the back wall, the leaf spring suspended between the holding mechanisms defines spaces between the holding mechanisms and the upper wall, the holding mechanisms hold the leaf spring at positions inwardly separated from opposite ends thereof, the pivotal shaft of the pull and the pawl rod are interposed between the leaf spring and the upper wing plate, and the cover is fixed to the front and back mounting parts.

The leaf spring may be formed in a shape of a rectangular plate provided with cutouts in a concave shape at respective centers of opposite ends thereof. The cover may be provided with projections as the holding mechanisms for holding the leaf spring, at a front and back ends of the inner face thereof so as to project from a center of the upper wall at positions inwardly separated from the front and back walls. The cutouts of the leaf spring may be engaged with the projections. Supporting pieces may be provided on inner faces of the side walls of the cover so as to be opposed to the projections at positions inwardly separated from the front and back walls. The supporting pieces may be folded to hold the leaf spring so that the leaf spring can swing in a vertical direction.

The leaf spring may be formed in a shape of a rectangular plate provided with cutouts in a concave shape at respective centers of opposite ends thereof. The cover may be provided with projections as the holding mechanisms for holding the leaf spring, at a front and back ends of the inner face thereof so as to project from a center of the upper wall at positions inwardly separated from the front and back walls, heads of the projections being spread toward the side walls at both sides. The cutouts of the leaf spring may be engaged with the projections. The heads of the projections may be spread thereby to hold the leaf spring so that the leaf spring can swing in a vertical direction.

Receiving parts for receiving the holding mechanisms which are provided on the inner faces of the cover maybe provided on the mounting parts which are uprightly provided in the front and in the back of the upper wing plate, the receiving parts being provided at respective positions inwardly separated from a front end and a back end of the mounting parts.

The front mounting part may have a shape of a pillar which is inclined at a back side and upright at a shoulder side. A locking recess into which a locking base portion of the pawl rod can be inserted may be formed at a center in a longitudinal direction of the front mounting part. A front receiving part which is recessed in a lateral direction may be provided in front of the locking recess at a position inwardly separated from a front end of the front mounting part thereby to receive the holding mechanism. The back mounting part may have a shape of a pillar which is inclined at a shoulder side and upright a back side. A pawl hole into which a stop pawl of the pawl rod can be inserted may be formed at a center in a longitudinal direction of the back mounting part. A back receiving part which is recessed entirely in a lateral direction may be provided in rear of the pawl hole at a position inwardly separated from a back end of the back mounting part thereby to receive the holding mechanism.

The projections may be provided at two positions on the inner face of the cover. Grooves for defining the spaces may be formed at both sides of the respective projections between the projections and the side walls. The supporting pieces whose tip ends are folded toward the projections thereby to hold the leaf spring may be provided so as to be projected from base parts of the side walls, at the positions inwardly separated from the front and back walls.

The projections may be provided at two positions on the inner face of the cover. Grooves for defining the spaces may be formed at both sides of the respective projections between the projections and the side walls. The heads of the projections may be spread toward the side walls at both side thereby to hold the leaf spring. The projections may be provided at the positions inwardly separated from the front and back walls.

Holding parts for holding the leaf spring when the leaf spring is held by engaging with the projections and by folding the supporting pieces, or when the leaf spring is held by spreading the heads of the projections to the right and left, may be provided at positions of the spaces in which the leaf spring can swing when being elastically deformed.

BRIEF DESCRIPTION OF THE DRAWINGS

Figure 1:
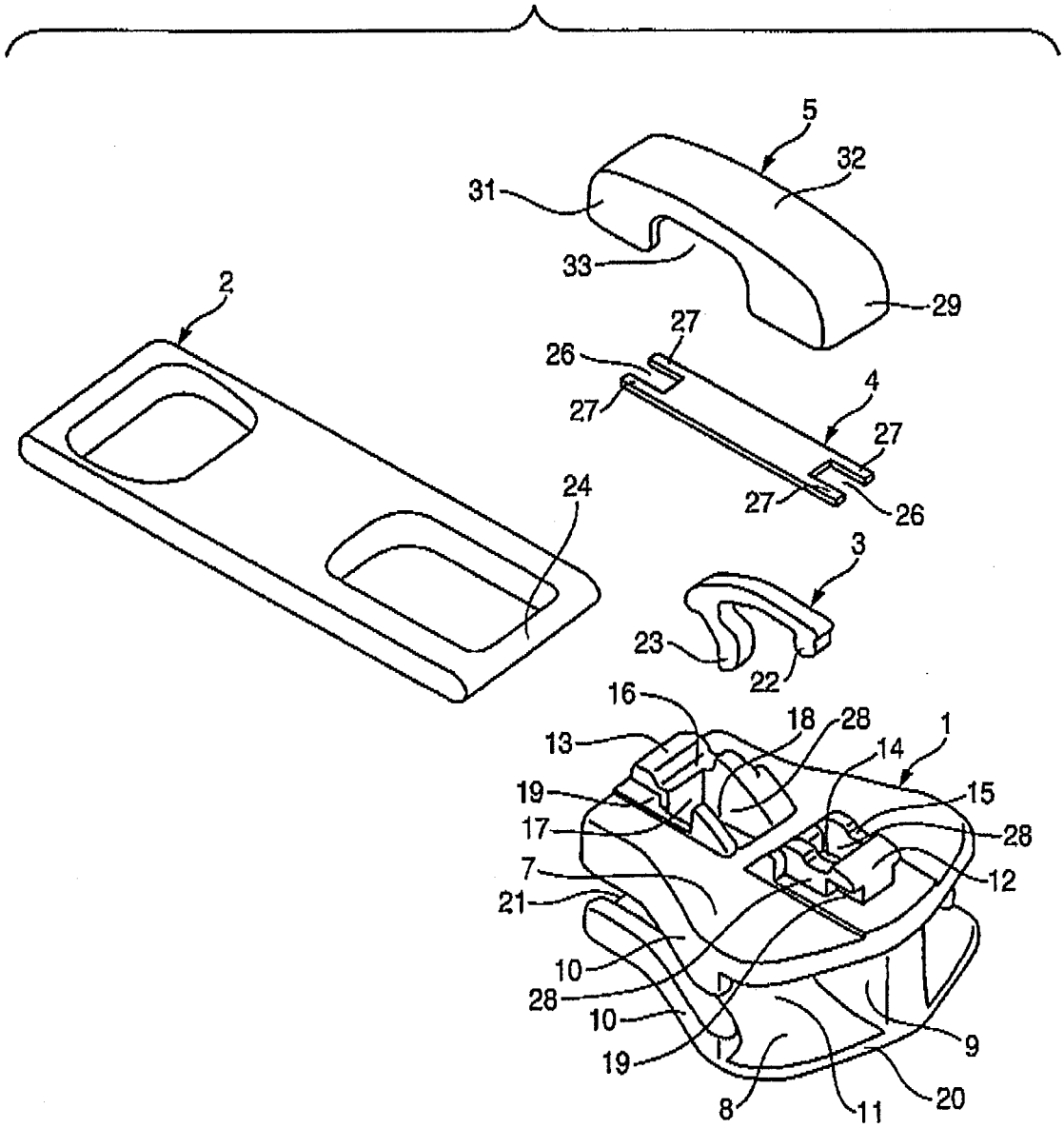

Having thus described various embodiments of the invention in general terms, reference will now be made to the accompanying drawings, which are not necessarily drawn to scale, and wherein:

FIG. 1 is an exploded perspective view of a slider for a slide fastener with an automatic stopper in Embodiment 1 of the invention.

Figure 2:
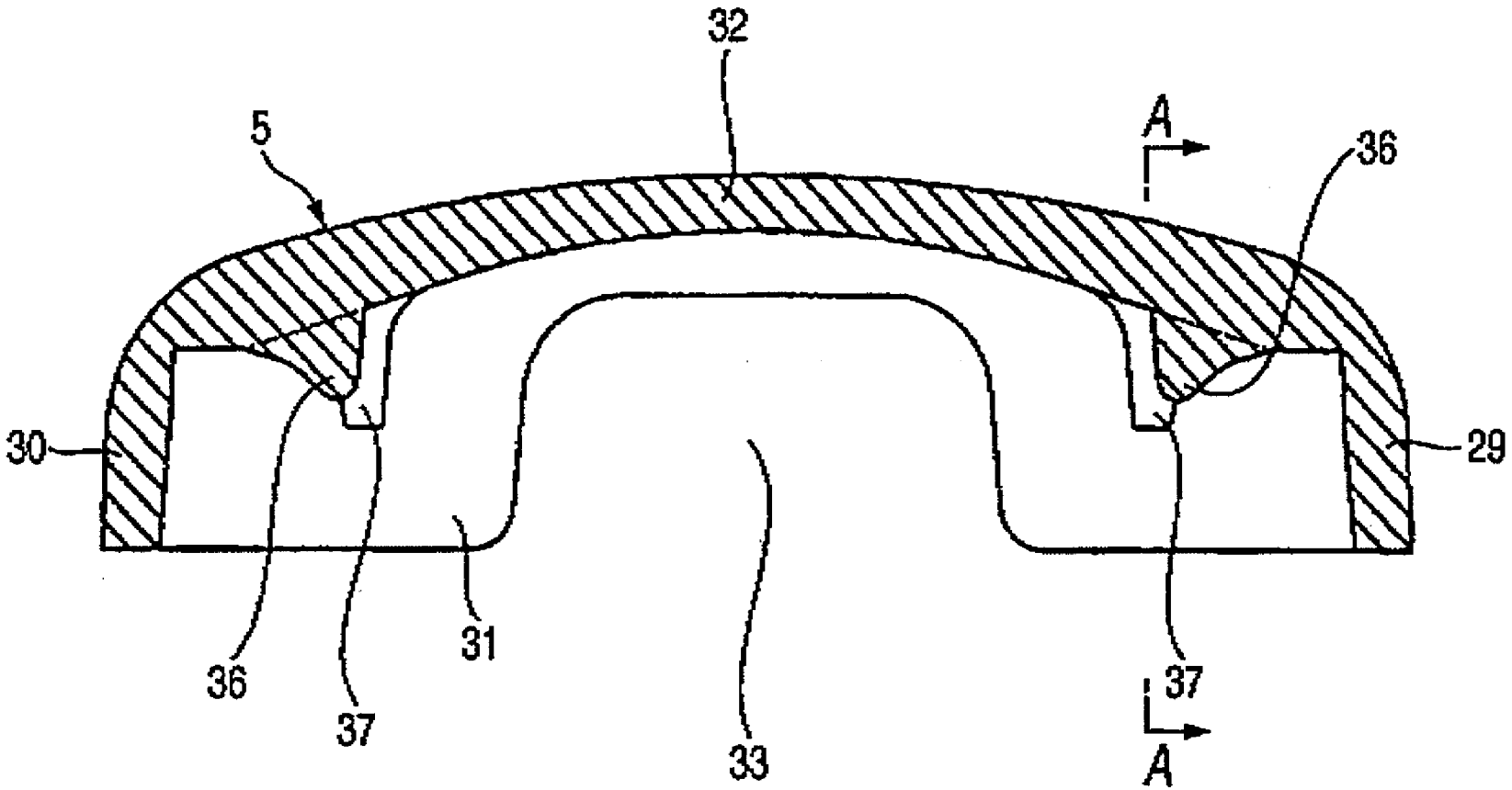

FIG. 2 is a sectional view of a cover of the slider.

Figure 3:
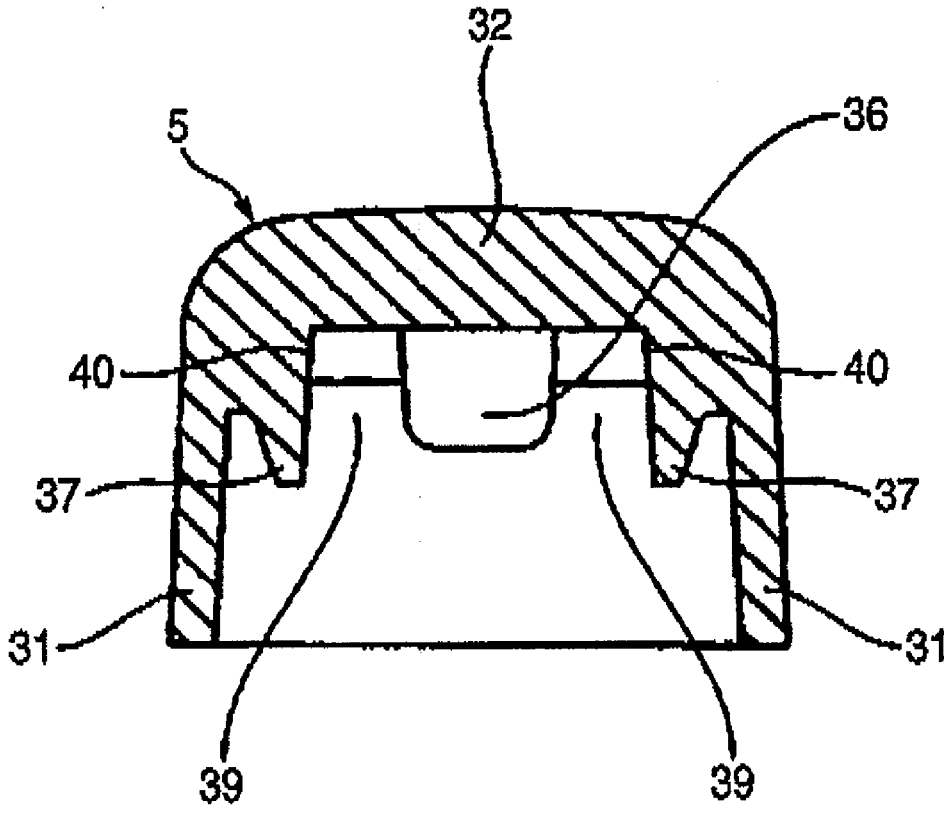

FIG. 3 is a sectional view of the cover taken along a line A-A in FIG. 2.

Figure 4:
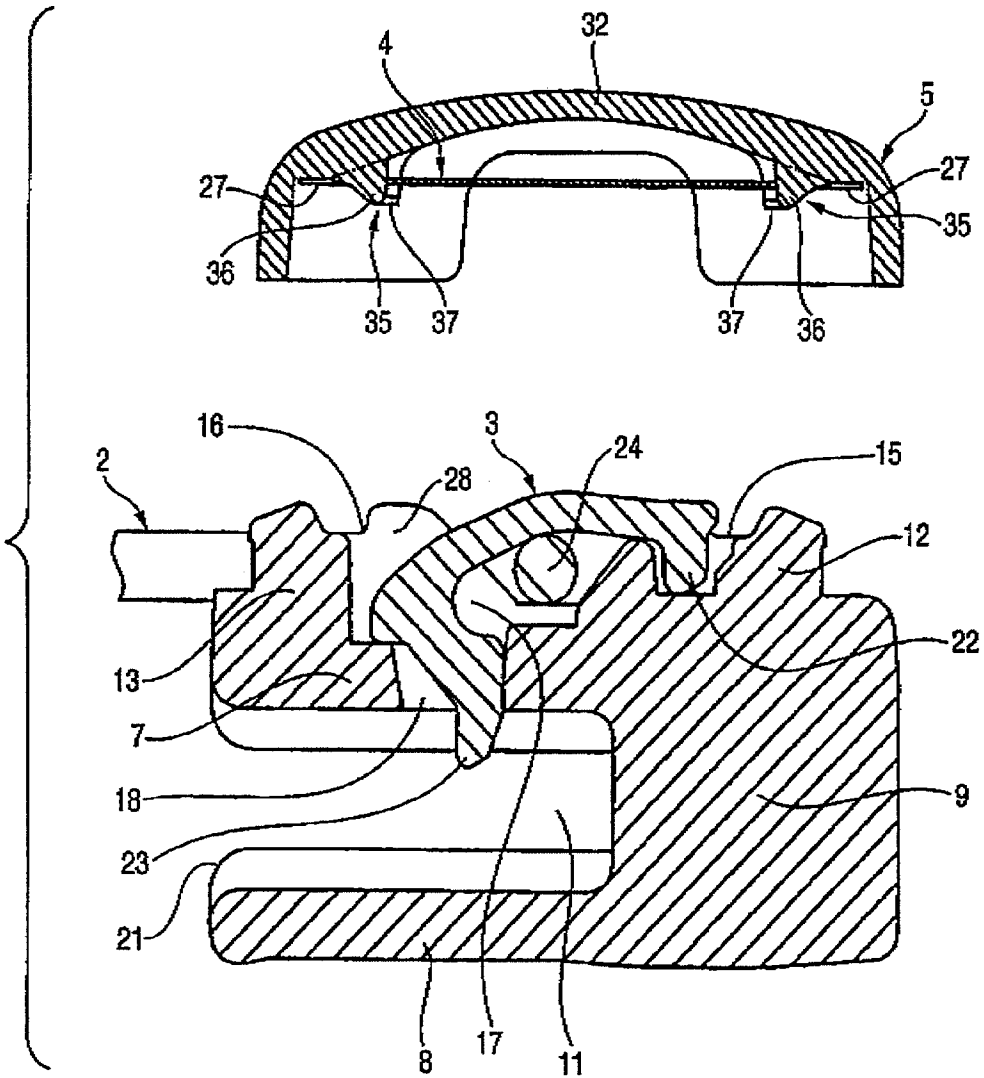

FIG. 4 is a view showing assembling steps of the slider.

Figure 5:
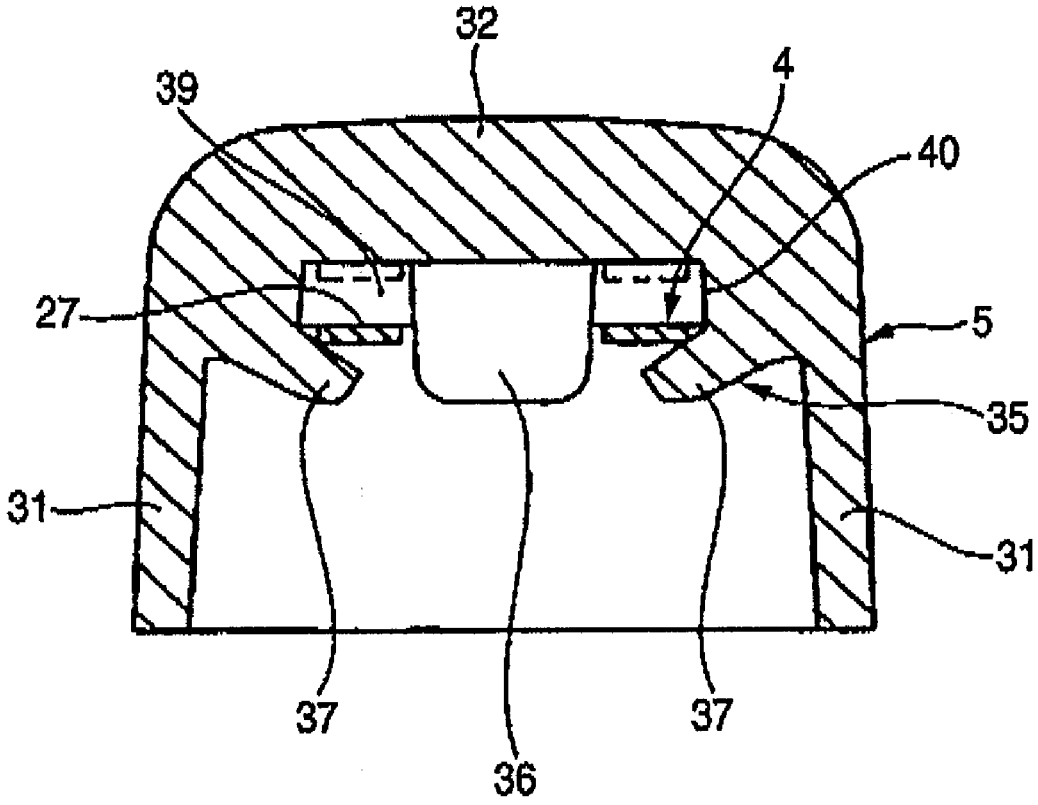

FIG. 5 is a sectional view of the cover in FIG. 3, after the cover has been worked.

Figure 6:
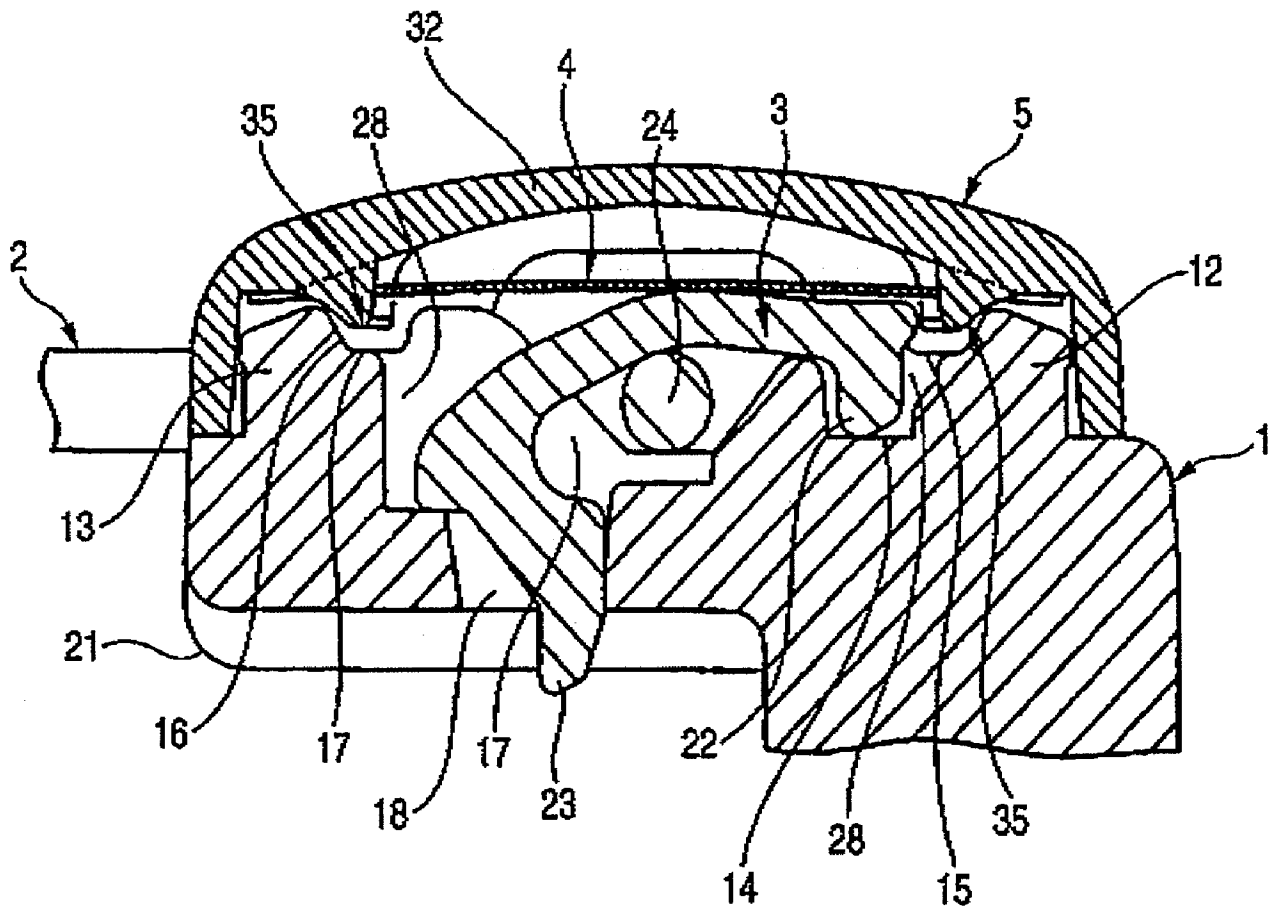

FIG. 6 is a sectional view of the slider after it has been assembled.

Figure 7:
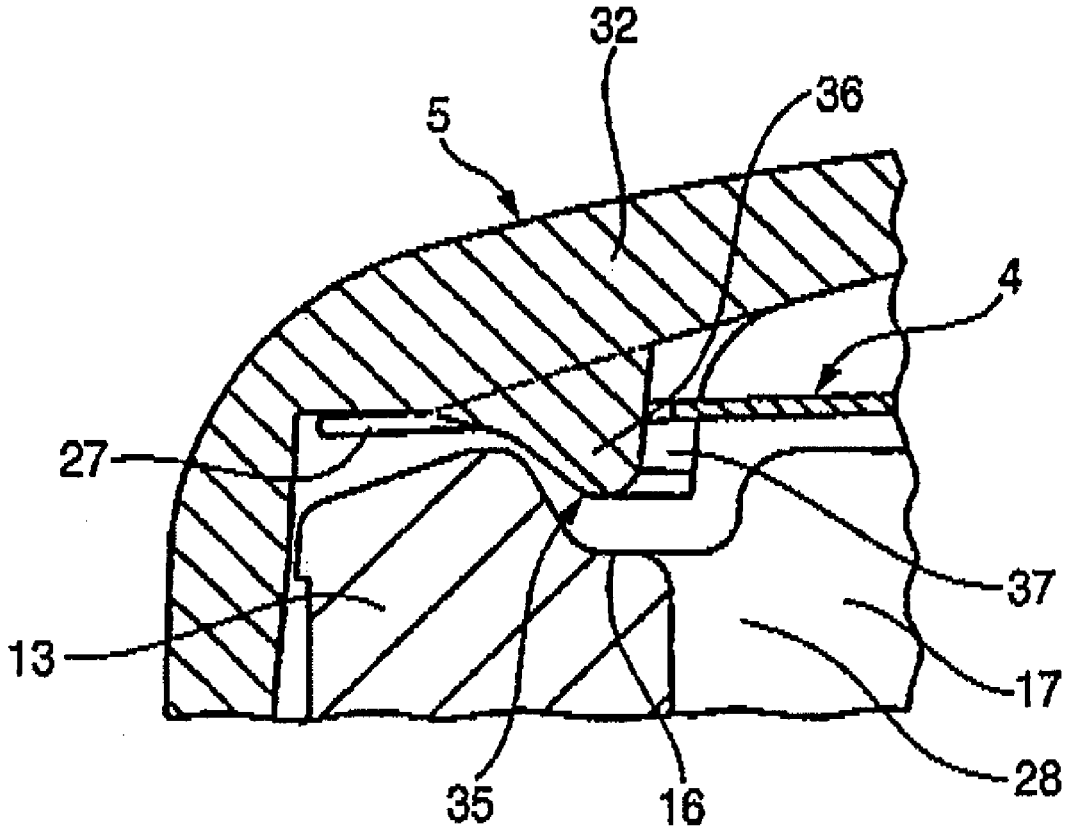

FIG. 7 is an enlarged sectional view showing a back mounting part of the slider.

Figure 8:
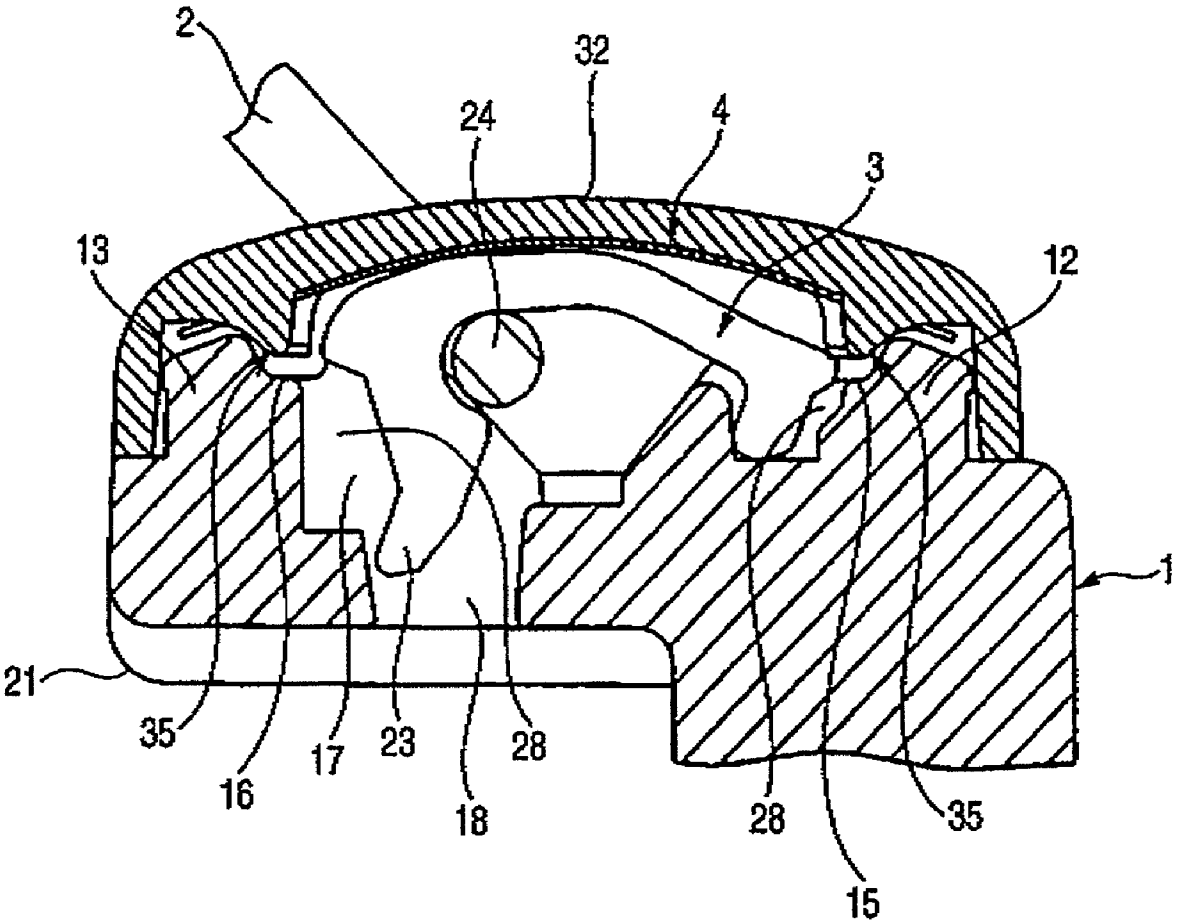

FIG. 8 is a sectional view showing a manner of using the slider.

Figure 9:
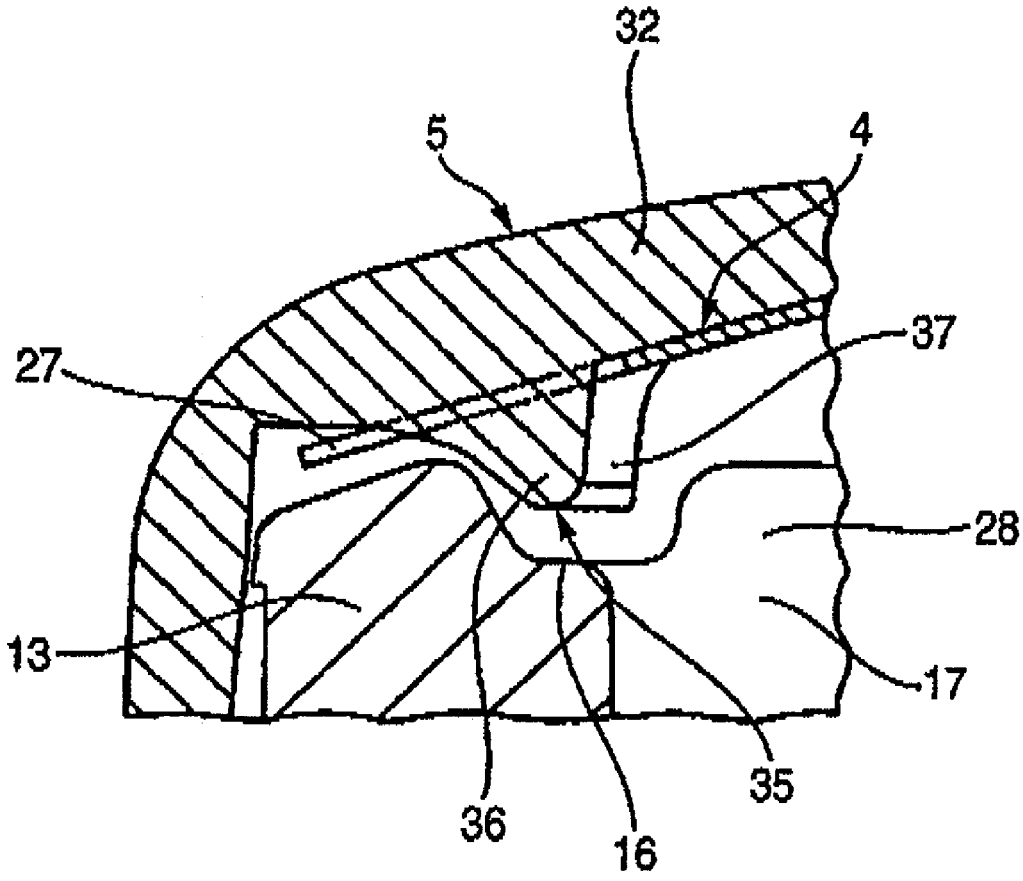

FIG. 9 is an enlarged sectional view showing a manner of using the slider in the back mounting part.

Figure 10:
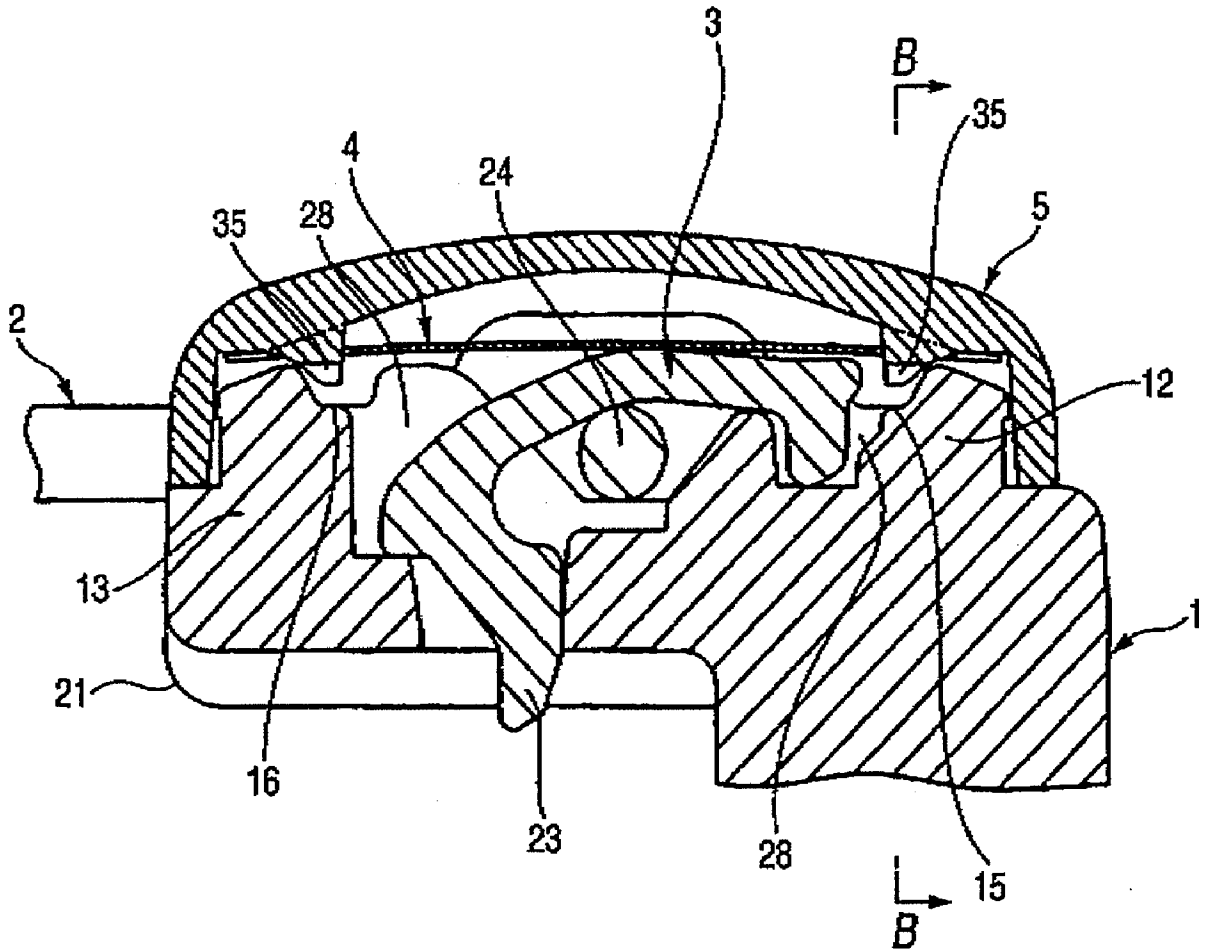

FIG. 10 is a sectional view of a slider in Embodiment 2, after it has been assembled.

Figure 11:
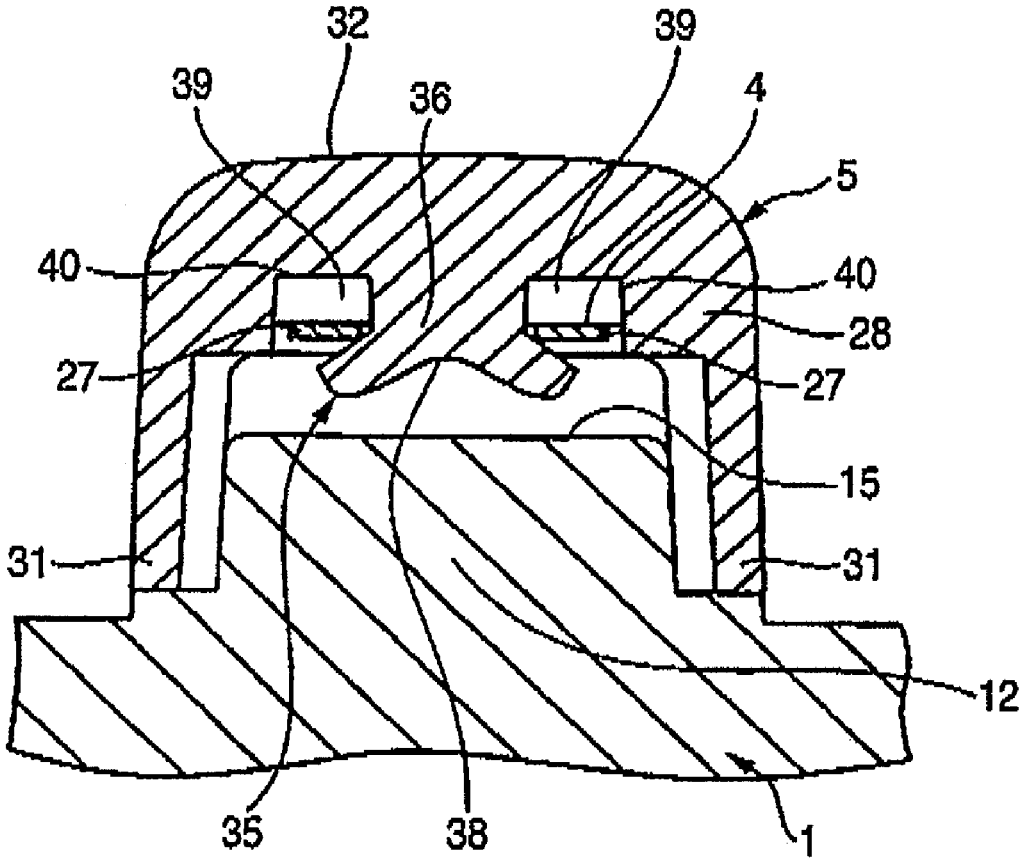

FIG. 11 is a sectional view of the slider taken along a line B-B in FIG. 10.

Figure 12:
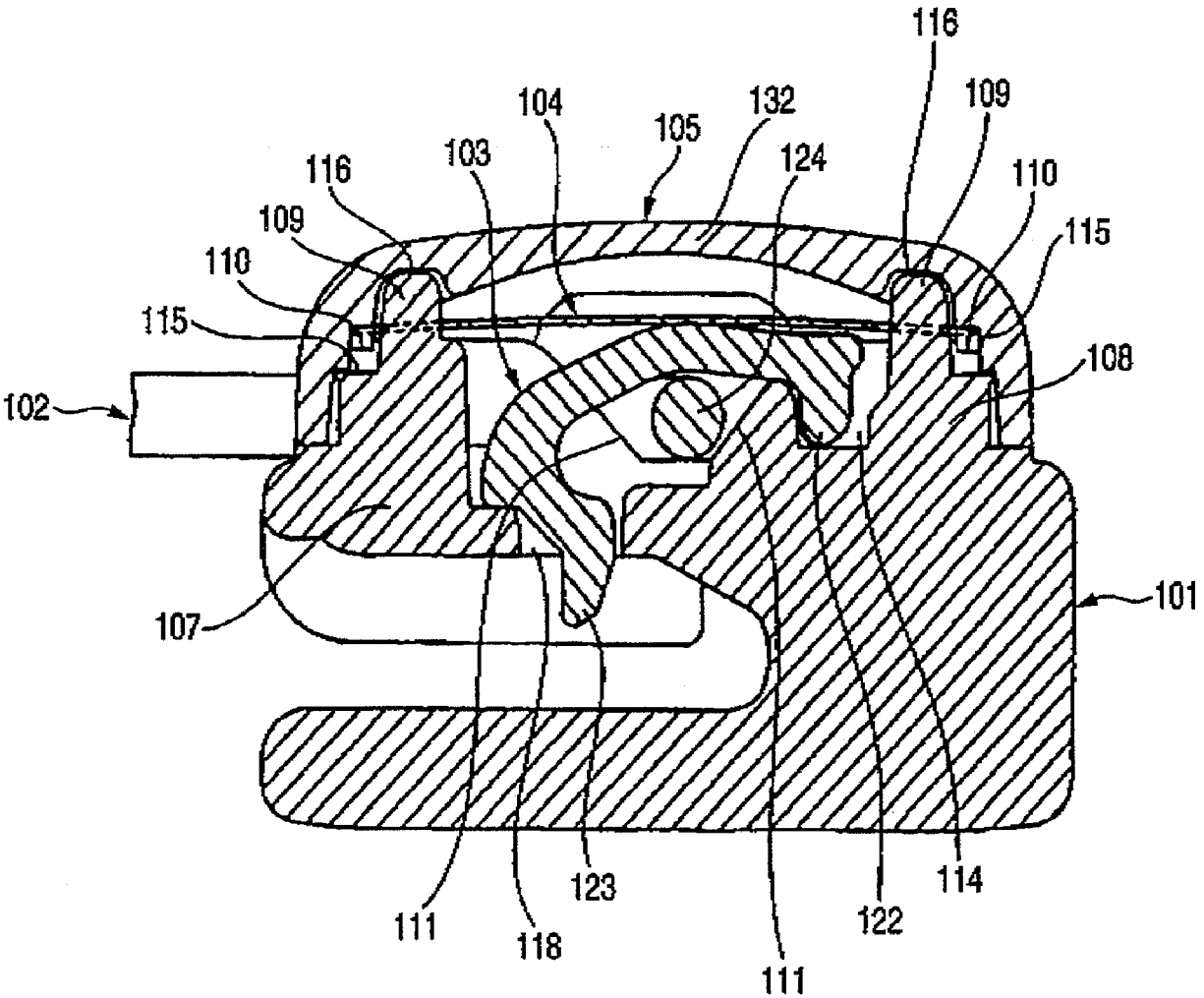

FIG. 12 is a sectional view of a related-art slider.

Figure 13:
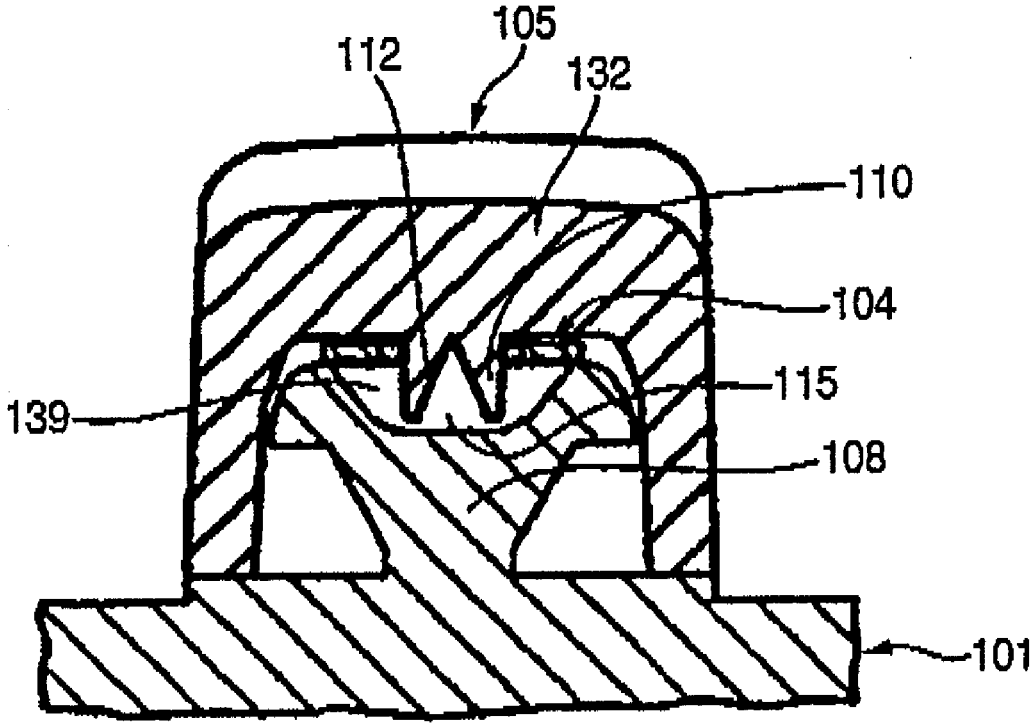

FIG. 13 is a sectional view showing a leaf spring holding part in the related-art slider.

Figure 14:
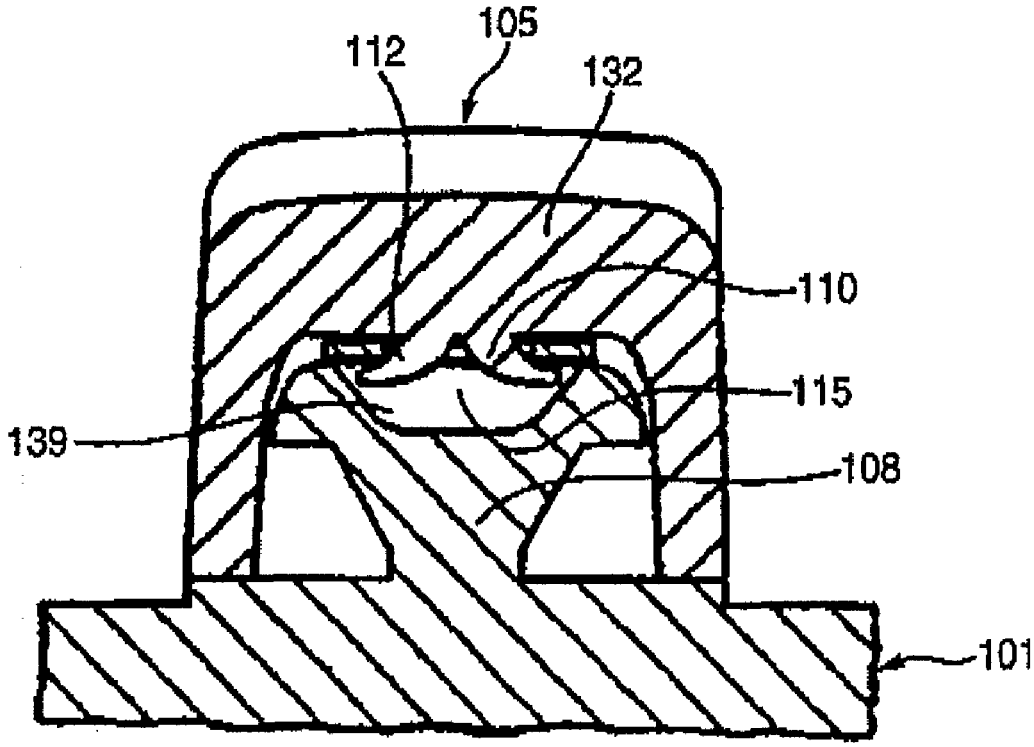

FIG. 14 is a sectional view showing the leaf spring holding part in the related-art slider.

DETAILED DESCRIPTION OF VARIOUS EMBODIMENTS OF THE INVENTION

The slider for the slide fastener with the automatic stopper according to various embodiments of this invention is formed of metal and includes five members, namely, a body 1, a pull 2, a pawl rod 3, a leaf spring 4, and a cover 5. A front mounting part 12 and a back mounting part 13 for mounting the cover 5 are respectively provided in the front and in the back on an upper face of an upper wing plate 7 of the body 1. The front mounting part 12 is formed in a shape of a pillar which is inclined at a back side 21 toward a center and upright at a shoulder side 20. A locking recess 14 into which a crooked locking base portion 22 of the pawl rod 3 can be inserted is provided at a center in a longitudinal direction of the front mounting part 12 (a longitudinal direction of the body 1), and a front receiving part 15 which is recessed in a lateral direction (a direction of width of the body 1) is provided in front of this locking recess 14 on an upper face of the front mounting part 12. This front receiving part 15 is provided in a state inwardly separated from a front end of the front mounting part 12 and adapted to receive a holding mechanism 35 which is provided inside the cover 5.

The back mounting part 13 is formed in a shape of a pillar which is inclined at a shoulder side 20 and upright at a back side 21. A pawl hole 18 into which a stop pawl 23 of the pawl rod 3 can be inserted is formed at a center in a longitudinal direction of the back mounting part 13, and a back receiving part 16 which is entirely recessed in a lateral direction is provided in rear of this pawl hole 18 on an upper face of the back mounting part 13 at a position inwardly separated from a back end of the back mounting part 13. The back receiving part 16 is adapted to receive the holding mechanism 35 which is provided inside the cover 5.

On the other hand, the leaf spring 4 and the cover 5 need not be assembled in advance, in case of automatic assembling. However, in case of manual assembling, the leaf spring 4 may drop from the cover 5, unless they have been assembled in advance. Now, the holding mechanism 35 will be described. Projections 36 which can be engaged with cutouts 26 of the leaf spring 4 are projected from a center of an inner face of the cover 5 at positions respectively separated from a front wall 29 and a back wall 30 of an upper wall 32. At both sides of the projections 36, there are formed grooves 40 having spaces 39 in which tongue pieces 27 of the leaf spring 4 can swing. Supporting pieces 37 capable of supporting the tongue pieces 27 of the leaf spring 4 are uprightly provided on side walls 31 of the cover 5 in parallel with the projections 36 and the side walls 31. Tip ends of these supporting pieces 37 are folded to restrict movement of the tongue pieces 27 for the purpose of holding the leaf spring 4 which has been engaged with the projections 36, and defines the spaces 39 so that the tongue pieces 27 can freely swing in the grooves 40. For this purpose, the supporting pieces 37 are inwardly folded at positions substantially equal to a depth of the grooves 40. In this manner, the holding mechanism 35 is completed.

In case of assembling the slider in this embodiment by employing an automatic assembling device, a pivotal shaft 24 of the pull 2 is inserted between the front and back mounting parts 12 and 13 of the body 1, as shown in FIG. 4, and the pawl rod 3 is placed thereon. On this occasion, the locking base portion 22 at one end of the pawl rod 3 is inserted into the locking recess 14 which is formed in the front mounting part 12 and the stop pawl 23 at the other end is inserted into the pawl hole 18. Then, the cover 5 in a state provided with the leaf spring 4 on the inner face thereof is placed thereon to cover the front and back mounting parts 12, 13, and the side walls 31 of the cover 5 are fixed by caulking to engaging recesses 19 which are provided on side faces of the front and back mounting parts 12, 13.

In case of manually assembling the slider, the leaf spring 4 having the cutouts 26 is assembled to the cover 5 by means of the projections 36 and the supporting pieces 37 which are provided on the cover 5. Then, the cover 5 is put on the pivotal shaft 24 of the pull 2 and the pawl rod 3 which are mounted on the front and back mounting parts 12, 13 of the body 1, and the side walls 31 of the cover 5 are fixed by caulking into the engaging recesses 19 which are formed on the side walls of the front and back mounting parts 12, 13.

The slider with the automatic stopper is characterized in that the tongue pieces 27 at the opposite ends of the leaf spring 4 can swing within the spaces 39 of the grooves 40 which are formed inside the cover 5, as shown in FIG. 9, and when the leaf spring 4 is elastically deformed, tip ends of the leaf spring 4 are separated from the upper wall 32 of the cover 5 enabling the leaf spring 4 to smoothly swing. In this manner, sliding movement of the slider can be smoothly operated.

The slider for the slide fastener with the automatic stopper according to one embodiment is shown in FIGS. 1 to 9 includes five members, namely, the body 1, the pull 2, the pawl rod 3, the leaf spring 4, and-the cover 5. These members are formed of aluminum alloy, zinc alloy or the like by die-cast molding, or formed of brass, stainless steel or the like by stamping. Moreover, a part of components of the slider may be formed of synthetic resin by injection molding.

The body 1 has the upper wing plate 7 and a lower wing plate 8 which are joined by a guide post 9. Flanges 10 for guiding a fastener element are formed by folding opposite sides of both the upper and lower wing plates 7, 8 or either one of the wing plates 7, 8 thereby to form guide grooves 11 through which the fastener element can be passed. The front mounting part 12 and the back mounting part 13 on which the leaf spring 4 and the cover 5 are to be mounted are provided at the shoulder side 20 and at the back side 21 of the upper face of the upper wing plate 7.

The front mounting part 12 is formed in a shape of a pillar which is inclined at the back side 21 and upright at the shoulder side 20. The locking recess 14 into which the crooked locking base portion 22 of the pawl rod 3 can be inserted is provided at a center in a longitudinal direction of the front mounting part 12, that is, a longitudinal direction of the body 1, and the front receiving part 15 which is recessed is provided at both sides and in front of this locking recess 14, that is at the shoulder side 20. It is possible for the receiving part 15 to receive the holding mechanism 35 for holding the leaf spring 4 which is provided inside the cover 5. As shown in FIGS. 6 and 7, the receiving parts are formed in such a shape that the supporting pieces 37 and the projections 36 as the holding mechanism 35 can enter therein without interfering with the front and back mounting parts 12, 13. The front receiving part 15 is formed at a position inwardly separated from the front end of the front mounting part 12, that is, toward the back side 21. The engaging recesses 19 which are further dented are formed on the side faces of the front mounting part 12, and when the cover 5 is attached, the side walls 31 of the cover 5 are fixed to the engaging recesses 19 by caulking.

The back mounting part 13 is formed in a shape of a pillar which is inclined at the shoulder side 20 and upright at the back side 21. The pawl hole 18 into which the crooked stop pawl 23 provided at the end of the pawl rod 3 can be inserted is provided at a center in a longitudinal direction. The pawl hole 18 is formed so as to communicate with the guide groove 11 from the surface of the upper wing plate 7, and a concave groove 17 into which the pawl rod 3 can be inserted communicates with the pawl hole 18. The back receiving part 16 which is recessed in a lateral direction is formed by both side parts of the concave groove 17 and a part of the back mounting part 13, at a position inwardly separated from the back end of the back mounting part 13. The engaging recesses 19 which are further dented are formed on the side faces of the back mounting part 13, and when the cover 5 is attached, the side walls 31 of the cover 5 are fixed to the engaging recesses 19 by caulking.

The front receiving part 15 and the rear receiving part 16 respectively receive the front and back holding mechanisms 35. It would be sufficient that the front and back receiving parts 15, 16 are positioned lower than the highest faces of the front and back mounting parts 12, 13, and have such shapes as not interfering with the holding mechanisms 35. Moreover, the front and back receiving parts 15, 16 are provided at positions closer to the shoulder side 20 or the back side 21 than open edges of openings 33—which are formed on the side walls 31 of the cover 5, when the slider is assembled. As shown in FIG. 6, the front receiving part 15 is recessed in upper parts of side plates 28 of the locking recess 14 into which the locking base portion 22 of the pawl rod 3 is inserted. A starting end and a backward end of this front receiving part 15 are formed at such positions as not interfering with the pawl rod 3. The front receiving part 15 is formed by denting the side plates 28 positioned at both sides of the locking recess 14 and an entire end face of the front mounting part 12 which is positioned in front of the locking recess 14 at the shoulder side 20. The back receiving part 16—is formed by denting upper parts of the side plates 28 positioned at both sides of the concave groove 17 into which the pawl rod 3 is inserted and an entire end face of the back mounting part 13 opposed to the concave groove 17. By forming the front receiving part 15 and the back receiving part 16 in this manner, the pawl rod 3 and the holding mechanisms 35 will not interfere with each other, and operation of the leaf spring 4 can be effectively achieved. Moreover, the leaf spring 4 is in a shape of a rectangular plate provided with the cutouts 26 at the center of the opposite ends thereof, and the tongue pieces 27 which are separated to the right and left are formed by the cutouts 26.

Now, the holding mechanism for holding the cover 5 and the leaf spring 4 will be described. The cover 5 is formed in a box-like shape having the front wall 29, the back wall 30, the side walls 31 at both sides, and the upper wall 32. The openings 33 through which the pivotal shaft 24 of the pull 2 can be passed are formed at respective centers of the side walls 31. The openings 33 open at an opposite side to the upper wall 32, and adapted to be closed with the upper wing plate 7 of the body 1. The projections 36 and the supporting pieces 37 which constitute the holding mechanisms 35 for holding the leaf spring 4 are provided in the front and back of the upper wall 32 of the cover 5. One of the projections 36 is provided at a center at a position inwardly separated from the front wall 29 of the cover 5. The grooves 40 which have a smaller depth than a distance from a lower face of the cover 5 to an inner face of the upper wall 32 are formed at both sides of the projection 36. The side walls 31 of the cover 5 at the both sides are provided with the supporting pieces 37 which can be folded over the grooves 40, at the position inwardly separated from the front wall 29 in parallel with the projections 36 and the side walls 31. In the same manner, the other projection 36 and the supporting pieces 37 are provided near the back wall 30 of the cover 5 at respective positions inwardly separated from the back wall 30. These supporting pieces 37 are inwardly separated from the opposite ends of the leaf spring 4, and the tip ends of the supporting pieces are folded toward the projection 36 at the substantially same position as the grooves 40, thereby to support the lower face of the leaf spring 4 and press the leaf spring 4 which is engaged with the projection 36, from outside. In this manner, the spaces 39 in which the tongue pieces 27 of the leaf spring 4 can swing are formed inside the grooves 40, as shown in FIG. 5, and the holding mechanisms 35 for holding the leaf spring will be completed in the front and in the back of the cover 5.

The upper wall 32 of the cover 5 is formed at such an angle that a height from the lower faces of the side walls 31 to the inner face of the upper wall 32 is gradually increased toward the center in the longitudinal direction. The projections 36 and the supporting pieces 3'7 as the holding mechanisms 35 are provided at the positions separated from the front wall 29 and the back wall 30 toward the center inside the inclined upper wall 32, and the spaces 39 in which the leaf spring 4 can swing in the vertical direction are formed. Moreover, the holding mechanisms 35 are formed closer to the front wall 29 and the back wall 30 than the open edges of the openings 33, and the supporting pieces 37 are folded toward the projection 36 thereby to hold the leaf spring 4 from the lateral direction. As the results, even though the leaf spring 4 is elastically deformed or moved in the longitudinal direction, the leaf spring will not be detached from the holding mechanisms. The end portions of the tongue pieces 27 are exposed from the supporting pieces 37, as shown in FIG. 7, and positioned between the front wall 29 or the back wall 30 and the supporting pieces 37 to be held in a stabilized state. What is meant by being exposed is that as shown in FIG. 5, in a state that the leaf spring 4 is supported by the supporting pieces 37, a part of the leaf spring 4 is not covered with the supporting pieces 37, while the other parts are covered. Further, a distance between the front wall 29 and the end portions of the tongue pieces 27 which face the front wall 29 and a distance between the back wall 30 and the end portions of the tongue pieces 27 which face the back wall 30 are shorter than a distance between the front wall 29 and the supporting pieces 37 which face the front wall 29 and a distance between the back wall 30 and the supporting pieces 37 which face the back wall 30.

In case of assembling the slider in this embodiment by employing the automatic assembling device, the pivotal shaft 24 of the pull 2 is inserted along the inclined faces of the front and back mounting parts 12 and 13 of the body 1, as shown in FIG. 4, and the pawl rod 3 is inserted so as to come into contact with the pivotal shaft 24 from the above. Then, the cover 5 in a state provided with the leaf spring 4 is placed thereon. On this occasion, the holding mechanisms 35 including the projections 36 and the supporting pieces 37 which are formed in the front and in the back of the cover 5 are idly engaged in the receiving parts 15, 16 which are formed in the front and back mounting parts 12, 13. Thereafter, the side walls 31 of the cover 5 are fixed by caulking to the engaging recesses 19 of the front and back mounting parts 12, 13. Therefore, in this state, the front and back mounting parts 12, 13 are positioned below the opposite ends of the leaf spring 4, and the opposite ends are opposed to the upper faces of the mounting parts 12, 13. There are sufficient gaps between the opposite ends of the leaf spring 4 and the upper faces of the mounting parts 12, 13 so that the leaf spring 4 can swing when it has been deformed.

When the slider is operated to slide, the stop pawl 23 is pulled up by pulling the pull 2, as shown in FIGS. 8 and 9. On this occasion, the leaf spring 4 is brought into contact with the upper wall 32, but the tip ends of the tongue pieces 27 at the opposite ends of the leaf spring 4 will not come into contact with the upper wall 32. Therefore, the tongue pieces 27 freely swing inside the spaces 39. The tongue pieces 27 are interposed between the folding points of the supporting pieces 37 which have been folded, and the inner face of the upper wall 32 inside the spaces 39. When the leaf spring 4 is elastically deformed, the tongue pieces 27 swing so as to move away from the folding points of the supporting pieces 37, and will not come into contact with the folding points of the supporting pieces 37. When the leaf spring 4 has been deformed from a state in FIG. 7 to a state in FIG. 9, the tongue pieces 27 can swing more freely than in the related-art slider. In this manner, elasticity of the leaf spring 4 can be fully utilized, and smooth operation of the slider can be attained.

The slider for the slide fastener with the automatic stopper according to another embodiment, is shown in FIGS. 10 and 11. This slider is different from the slider in above-described embodiment in the structure of the holding mechanisms 35 for holding the leaf spring 4. In this embodiment, each of the projections 36 formed on the inner face of the upper wall 32 of the cover 5 has a head provided with a cutting 38 or a V-shaped groove. After the leaf spring 4 has been engaged with the projections 36, the heads of the projections 36 are spread toward the right and left side walls 31 thereby to secure the leaf spring 4. The projections 36 in a state of holding the leaf spring 4 are inserted into the cutouts 26 of the leaf spring 4 thereby to hold the tongue pieces 27 from inside. In this embodiment, the leaf spring 4 can be held in a stabilized state, since the leaf spring 4 is held from the lateral direction. The spaces 39 can be formed at the grooves 40, by providing dividing points of the projections 36 at the substantially same position as the grooves 40.

It is also possible to construct the holding mechanisms for holding the leaf spring in such a manner that the leaf spring can be held in a snapping manner, by forming the projections in a spread shape, besides the caulking work. In this case, the holding mechanisms may be formed of resin by injection molding, and the dividing points of the projections may be formed by undercutting.

The slider for the slide fastener with the automatic stopper according to the invention can be used by attaching it to all the products, for example, clothes, bags, boots, etc. Sliding operation of the slider can be easily performed with small sliding resistance.

According to an aspect of the invention, the slider includes the body, the pull, the pawl rod, the leaf spring and the cover, wherein the cover includes the front wall, the back wall, the side walls and the upper wall, the side walls being provided at the respective centers thereof with the openings through which the pivotal shaft of the pull can be passed, a pair of mounting parts are provided in the front and in the back on the upper wing plate of the body, and the holding mechanisms for holding the leaf spring are provided in the front and in the back on the inner face of the cover at positions inwardly separated from the front wall and the back wall, wherein the spaces are formed between the holding mechanisms and the upper wall, the holding mechanisms hold the leaf spring at positions inwardly separated from its opposite ends, the pivotal shaft of the pull and the pawl rod are interposed between the leaf spring and the upper wing plate, and the cover is fixed to the front and back mounting parts.

Because the holding mechanisms for holding the leaf spring are provided in the front and in the back on the inner face of the cover at the positions inwardly separated from the front wall and the back wall, support points of the leaf spring can be arranged at positions inwardly separated, and the opposite ends of the leaf spring can freely swing in the vertical direction. Moreover, the opposite ends of the leaf spring are exposed and can loosely move, although they are in tight contact with the upper wall of the cover, and therefore, elasticity of the leaf spring can be sufficiently exerted. Further, because the leaf spring is held at the positions separated from the end parts thereof, the leaf spring can be held by the body in a stabilized state, and hence, the slider having high quality can be obtained.

According to various embodiments of the invention, the leaf spring is formed in a shape of a rectangular plate provided with the cutouts in a concave shape at the respective centers of its opposite ends, and the cover is provided with the projections, as the holding mechanisms for holding the leaf spring at the front and back ends of the inner face thereof so as to project from the center of the upper wall at positions inwardly separated from the front and back walls, the cutouts of the leaf spring are engaged with the projections, and the supporting pieces are provided on the inner faces of the side walls of the cover so as to be opposed to the projections at positions inwardly separated from the front and back walls, wherein the supporting pieces are folded to hold the leaf spring so as to swing in the vertical direction. Because the projections are provided at the positions separated from the opposite ends-of the cover, and the supporting pieces are also provided at the positions separated from the opposite ends of the cover, the leaf spring can be held by cooperation of both the members, and effective elasticity of the leaf spring can be exerted with a simple structure.

According to various embodiments of the invention, the leaf spring is formed in a shape of a rectangular plate provided with the cutouts in a concave shape at the respective centers of its opposite ends, and the cover is provided with the projections as the holding mechanisms for holding the leaf spring at the front and back ends of the inner face thereof so as to project from the center of the upper wall at positions inwardly separated from the front and back walls, the respective heads of the projections being spread toward the side walls at both sides, wherein the cutouts of the leaf spring are engaged with the projections, and the heads of the projections are spread thereby to hold the leaf spring so as to swing in the vertical direction. Because the projections whose heads are spread for securing the leaf spring are provided at the positions separated from the opposite ends of the cover, the slider has a simple structure and can be easily produced.

According to various embodiments of the invention, the receiving parts for receiving the holding mechanisms which are provided on the inner faces of the cover are provided on the mounting parts which are uprightly provided in the front and in the back of the upper wing plate, the receiving parts being at the respective positions inwardly separated from the front end and the back end of the mounting parts. Therefore, it is possible to easily and reliably incorporate the holding mechanisms for holding the leaf spring which are provided on the inner face of the cover, and the slider provided with the leaf spring having excellent functions can be obtained.

According to various embodiments of the invention, the front mounting part capable of receiving the holding mechanism has a shape of a pillar which is inclined at the back side and upright at the shoulder side, and the locking recess into which the locking base portion of the pawl rod can be inserted is formed at the center in a longitudinal direction of the front mounting part, the front receiving part which is recessed in a lateral direction is provided in front of the locking recess at the position inwardly separated from the front end of the front mounting part thereby to receive the holding mechanism, whereas the back mounting part has a shape of a pillar which is inclined at the shoulder side and upright at the back side, and the pawl hole into which the stop pawl of the pawl rod can be inserted is formed at the center in a longitudinal direction of the back mounting part, the back receiving part which is entirely recessed in a lateral direction is provided in rear of the pawl hole at the position inwardly separated from the back end of the back mounting part thereby to receive the holding mechanism. Therefore, it is possible to produce the body of the slider in such a structure that the leaf spring and the cover can be effectively and easily mounted thereon, and the respective members can efficiently cooperate with each other to perform smooth operation.

According to various embodiments of the invention, the projections are provided at the two positions on the inner face of the cover, the grooves for defining the spaces are formed at both sides of the respective projections between the projections and the side walls, and the supporting pieces whose tip ends are folded toward the projections thereby to hold the leaf spring are provided so as to be projected from the base parts of the side walls, at the positions inwardly separated from the front and back walls. Therefore, the projections and the supporting pieces which are provided on the inner face of the cover are effectively related to each other, and it is possible to appropriately provide the spaces inside the grooves.

According to various embodiments of the invention, the projections are provided at the two positions on the inner face of the cover, the grooves for defining the spaces are formed at both sides of the respective projections between the projections and the side walls, the respective heads of the projections being spread toward the side walls at both side thereby to hold the leaf spring, and the projections are provided at the positions inwardly separated from the front and back walls. Therefore, because the heads of the projections are spread toward the side walls thereby to hold the leaf spring, mounting work of the leaf spring can be easily conducted, and the leaf spring can be held at the two positions inside the cover in a stabilized state.

According to various embodiments of the invention, the holding parts for holding the leaf spring when the leaf spring is held by engaging it with the projections and by folding the supporting pieces, or the leaf spring is held by spreading the heads of the projections to the right and left, are provided at the positions of the spaces in which the leaf spring can swing when it is elastically deformed. Therefore, the folding mechanisms of the supporting pieces for holding the leaf spring and the spreading mechanisms of the projections define the spaces in which the opposite ends of the leaf spring can freely swing in the vertical direction, and swing motion of the leaf spring will not be hindered. In this manner, the invention can achieve such extraordinary advantages that the slider provided with the automatic stopping mechanism of enhanced quality can be obtained, and so on.

What is claimed is:

1. A slider for a slide fastener with an automatic stopper, comprising;

a body;

a pull;

a pawl rod;

a leaf spring; and a cover, wherein:

the cover includes a front wall, a back wall, side walls and an upper wall, the side walls are provided at respective centers thereof with openings through which a pivotal shaft of the pull can be passed, a pair of mounting parts are provided in the front and in the back on an upper wing plate of the body, holding mechanisms for holding the leaf spring are provided in the front and in the back on an inner face of the cover at respective positions inwardly separated from the front wall and the back wall, the holding mechanisms include first projections which are provided so as to project from a center of an inner face of the upper wall at positions inwardly separated from the front and back walls and with which the leaf spring is engaged, the holding mechanisms include second projections which project from portions in the cover to hold the leaf spring at corresponding positions to the first projections in a lateral direction, the upper wall is formed with grooves between the first projections and the side walls, the leaf spring suspended between the holding mechanisms defines spaces between the holding mechanisms and the upper wall, the spaces are defined by the grooves and the portions from which the second projections project, the holding mechanisms hold the leaf spring at positions inwardly separated from opposite ends thereof, the pivotal shaft of the pull and the pawl rod are interposed between the leaf spring and the upper wing plate, and the cover is fixed to the mounting parts.

2. The slider as claimed in claim 1, wherein:

the second projections correspond to supporting pieces which are provided on inner faces of the side walls of the cover so as to be opposed to the first projections at positions inwardly separated from the front and back walls and which are folded to hold the leaf spring so that the leaf spring can swing in a vertical direction.

3. The slider as claimed in claim 2, wherein one of the mounting parts, which is provided in the front, has a shape of a pillar which is inclined at a back side thereof and upright at a shoulder side thereof, a locking recess into which a locking base portion of the pawl rod can be inserted is formed at a center in a longitudinal direction of the one of the mounting parts, a front receiving part which is recessed in a lateral direction is provided in front of the locking recess at a position inwardly separated from a front end of the one of the mounting parts thereby to receive one of the holding mechanisms, the other of the mounting parts, which is provided in the back, has a shape of a pillar which is inclined at a shoulder side thereof and upright at a back side thereof, a pawl hole into which a stop pawl of the pawl rod can be inserted is formed at a center in a longitudinal direction of the other of the mounting parts, and a back receiving part which is recessed entirely in a lateral direction is provided in rear of the pawl hole at a position inwardly separated from a back end of the other of the mounting parts thereby to receive the other of the holding mechanisms.

4. The slider as claimed in claim 2, wherein the supporting pieces whose tip ends are folded toward the first projections thereby to hold the leaf spring are provided so as to be projected from base parts of the side walls, at the positions inwardly separated from the front and back walls.

5. The slider as claimed in claim 1, wherein the second projections correspond to heads of the first projections which are spread toward the side walls so as to hold the leaf spring so that the leaf spring can swing in a vertical direction.

6. The slider as claimed in claim 5, wherein one of the mounting parts, which is provided in the front, has a shape of a pillar which is inclined at a back side thereof and upright at a shoulder side thereof, a locking recess into which a locking base portion of the pawl rod can be inserted is formed at a center in a longitudinal direction of the one of the mounting parts, a front receiving part which is recessed in a lateral direction is provided in front of the locking recess at a position inwardly separated from a front end of the one of the mounting parts thereby to receive one of the holding mechanisms, the other of the mounting parts, which is provided in the back, has a shape of a pillar which is inclined at a shoulder side thereof and upright at a back side thereof, a pawl hole into which a stop pawl of the pawl rod can be inserted is formed at a center in a longitudinal direction of the other of the mounting parts, and a back receiving part which is recessed entirely in a lateral direction is provided in rear of the pawl hole at a position inwardly separated from a back end of the other of the mounting parts thereby to receive the other of the holding mechanisms.

7. The slider as claimed in claim 1, wherein receiving parts for receiving the holding mechanisms are provided on the mounting parts which are uprightly provided in the front and in the back of the upper wing plate, the receiving parts being provided at respective positions inwardly separated from a front end and a back end of the mounting parts.

8. The slider as claimed in claim 1, wherein the leaf spring is formed in a shape of a rectangular plate provided with cutouts in a concave shape at respective centers of opposite ends thereof, and the cutouts of the leaf spring are engaged with the projections.

* * * * *